US006250050B1

(12) United States Patent
Grigsby, Sr.

(10) Patent No.: US 6,250,050 B1
(45) Date of Patent: Jun. 26, 2001

(54) WING-END WOOD-CLEATED CORRUGATED PAPERBOARD CONTAINER AND METHOD

(75) Inventor: John M. Grigsby, Sr., Marietta, GA (US)

(73) Assignee: North American Container Corp., Mableton, GA (US)

( * ) Notice: Subject to any disclaimer, the term of this patent is extended or adjusted under 35 U.S.C. 154(b) by 0 days.

(21) Appl. No.: 09/523,893

(22) Filed: Mar. 13, 2000

(51) Int. Cl.[7] ..... B65D 19/02

(52) U.S. Cl. ..... 53/452; 206/335; 206/386; 229/199.1

(58) Field of Search ..... 53/396, 397, 452, 53/456; 206/319, 335, 386, 600; 229/162, 199, 199.1

(56) References Cited

U.S. PATENT DOCUMENTS

| | | | |
|---|---|---|---|
| 939,026 | 11/1909 | Howland . | |
| 1,787,305 | 12/1930 | Campbell . | |
| 2,042,323 | 5/1936 | Ott | 217/16 |
| 2,110,150 | 3/1938 | Hile | 217/16 |
| 2,141,497 | 12/1938 | Watkins | 217/48 |
| 2,159,642 | 5/1939 | Watkins | 217/48 |
| 2,316,854 | 4/1943 | George et al. | 217/13 |
| 2,346,003 | 4/1944 | Bishop | 229/23 |
| 2,361,937 | 11/1944 | Gondert | 217/12 |
| 2,488,692 | 11/1949 | Talbot | 217/12 |
| 2,525,838 | 10/1950 | Smith et al. | 217/16 |
| 2,596,320 | 5/1952 | Witte | 217/12 |
| 2,672,252 | 3/1954 | Frear | 217/48 |
| 2,808,956 | 10/1957 | Johnson | 217/48 |
| 2,812,096 | 11/1957 | Muller | 217/65 |
| 2,887,241 | 5/1959 | MacKenzie | 217/12 |
| 3,045,889 | 7/1962 | Whiton | 229/41 |
| 3,451,578 | 6/1969 | Edmundson | 217/48 |
| 3,650,459 * | 3/1972 | Tucker | 229/199 |
| 3,727,786 | 4/1973 | Fausel | 217/16 |
| 3,874,543 | 4/1975 | Farnsworth | 217/48 |
| 4,171,741 | 10/1979 | Fish | 206/335 |
| 4,832,256 | 5/1989 | Grigsby | 229/23 C |
| 5,004,102 * | 4/1991 | Timmins et al. | 206/386 |
| 5,096,112 | 3/1992 | Grigsby | 229/23 C |
| 5,501,333 * | 3/1996 | Swan | 206/386 |
| 5,622,306 | 4/1997 | Grigsby, Sr. | 229/23 C |
| 5,829,189 | 11/1998 | Grigsby, Sr. | 217/48 |
| 6,003,704 | 12/1999 | Grisby, Jr. | 217/16 |

FOREIGN PATENT DOCUMENTS

| | | |
|---|---|---|
| 544415 | 5/1952 | (CA) . |
| 1265313 | 5/1961 | (FR) . |
| 311983 | 7/1929 | (GB) . |

OTHER PUBLICATIONS

"Wood–Cleated Corrugated", North American Container Corp.

* cited by examiner

*Primary Examiner*—Jim Foster
(74) *Attorney, Agent, or Firm*—Baker, Donelson, Bearman & Caldwell

(57) ABSTRACT

A packing container for enclosing heavy durable goods for storage and shipping having a base frame for supporting an article to be packaged. A pair of opposing wing-end panels are received at opposing ends of the base frame with each wing-end panel comprising a sheet of corrugated paperboard scored to define an end panel separating two side wing panels. A cleat attaches at each side edge and at the scores on each sheet. The side panels fold as wings to cover portions of the opposing sides of the container while leaving a gap on each side between the side edges of the two opposing side wing-end panels. A top frame is received by the pair of opposing wing-end panels. A method of packaging goods in a container is disclosed.

25 Claims, 2 Drawing Sheets

WING-END WOOD-CLEATED CORRUGATED PAPERBOARD CONTAINER AND METHOD

TECHNICAL FIELD

The present invention relates to corrugated paperboard containers. More particularly, the present invention relates to containers readily assembled with elongate wood-cleated corrugated paperboard sheets that define opposing ends and portions of opposing sides of the container for enclosing heavy durable goods for storage and shipping.

BACKGROUND OF THE INVENTION

Packaging of heavy equipment and machinery such as lawn and garden tractors, riding lawn mowers, snowmobiles, all-terrain vehicles, and the like, present many unique considerations. Such machinery by its nature is difficult to handle and store. The weight of the machinery requires strong enclosures for handling. The large sizes of these goods typically leads to stacking of containers one on another in warehouse storage and in trailer trucks carrying the goods from manufacturers to distributors and retailers. The containers thus need to have sufficient top loading strength to withstand the load imposed by the loaded containers held in the stacks. The package not only needs to be stackable, but also must have racking strength. Racking strength refers to the diagonal integrity of the packing to withstand the vibration and motions of shipping. The vibrations and handling tend to induce the staples of wooden crates to loosen to become detached. Screws tend to split the wood. Crates and some packages accordingly are often unable to maintain an upright stack. The pack begins to sag diagonally.

Handling of the containers by fork lift or platen truck also place loading and stress on the container. Fork lifts have extending forks that slide into a pallet for lifting the container. Clamp trucks have parallel plates or "platens" which move laterally under hydraulic pressure to squeeze the package, enabling the package to be lifted and moved about. Usually the platens are positioned to bear firmly against the base frame and a portion of the vertical cleated side wall. This lateral inward pressure may however cause the side wall to separate from the top frame.

Conventional corrugated paperboard containers are generally unsuitable for packaging heavy equipment. To provide sufficient compression strength to the pack, containers typically use wood cleats. These containers include wood cleated crates and cleat-reinforced corrugated paperboard containers, with mating rigid base and top frames. One known wood-cleated corrugated paperboard container uses six cleats to provide the stacking strength for the container, whereby multiple units can be stored one on top of another in a warehouse or shipping environment. The container comprises a tubular body formed from a sheet of corrugated paperboard scored to define four wall panels. The sheet folds on the scores and the opposing distal ends adhere together to form the tubular body. A vertical cleat is positioned on the panels for each of the corners of the container and two opposing cleats are positioned between the ends on the long sides of the container.

While the wood crates and cleat reinforced corrugated containers enclose products, there are drawbacks to their use. Occasionally, a run of a production line produces products which need minor repairs or corrections. For example, an incorrect part may have been placed in the production line and assembled into the product. In other circumstances, inspections must be made of the products to evaluate whether repairs are necessary. This requires engineers to open the containers stacked in the warehouses, examine the goods in the containers, and determine whether repairs are required. Generally, these activities involve moving the containers from the stack to a work position, opening the container, and removing the goods, for inspection and repair. The goods must then be replaced into the container, and the container closed and returned to storage. These activities are time consuming and involve significant labor.

Accordingly, there is a need in the art for an improved wood-cleated corrugated paperboard container for packaging heavy durable goods for storage and shipping. It is to such that the present invention is directed.

BRIEF SUMMARY OF THE INVENTION

The present invention meets the need in the art providing a wood-cleated corrugated paperboard container for enclosing heavy durable goods for storage and shipping, comprising a base frame for supporting an article to be packaged for storage and shipping. A pair of opposing wing-end panels are received at opposing ends of the base frame. Each wing-end panel comprises an elongate sheet of corrugated paperboard scored to define an end panel separating two side wing panels. At least four spaced-apart cleats attach to an interior surface of the elongate sheet with one cleat at each side edge and one at each of the scores. The end panel is received at one end of the base frame with the two side wing panels folding on the respective scores to cover portions of the opposing sides of the container. The respective opposing side wing panels on each side of the container leave a gap between the opposing edges of the two side wing panels for accessing the goods held in the container. A top frame is received by the pair of opposing wing-end panels.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
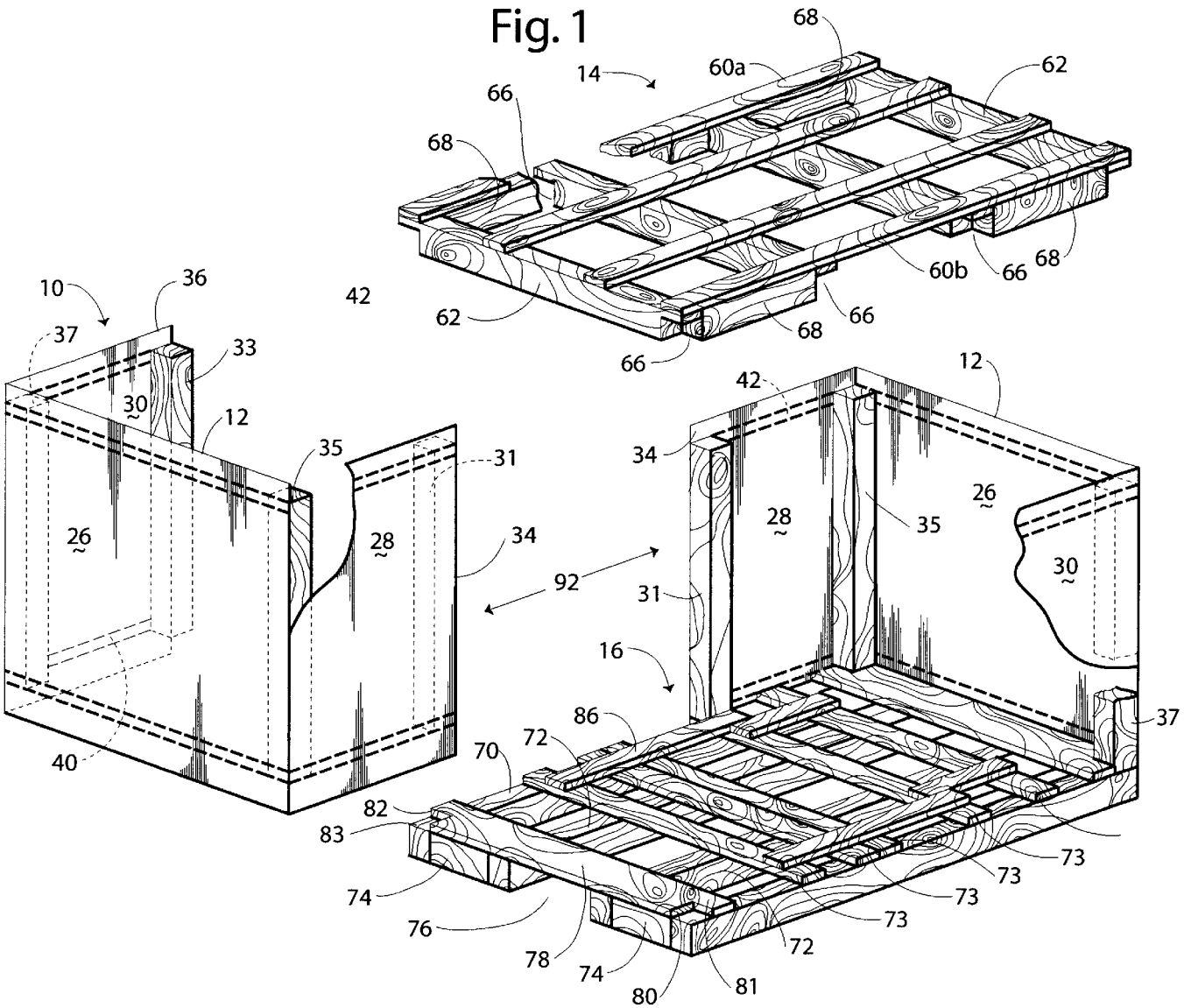
FIG. 1 illustrates an exploded perspective view of the wing-end container according to the present invention.
Figure 2:
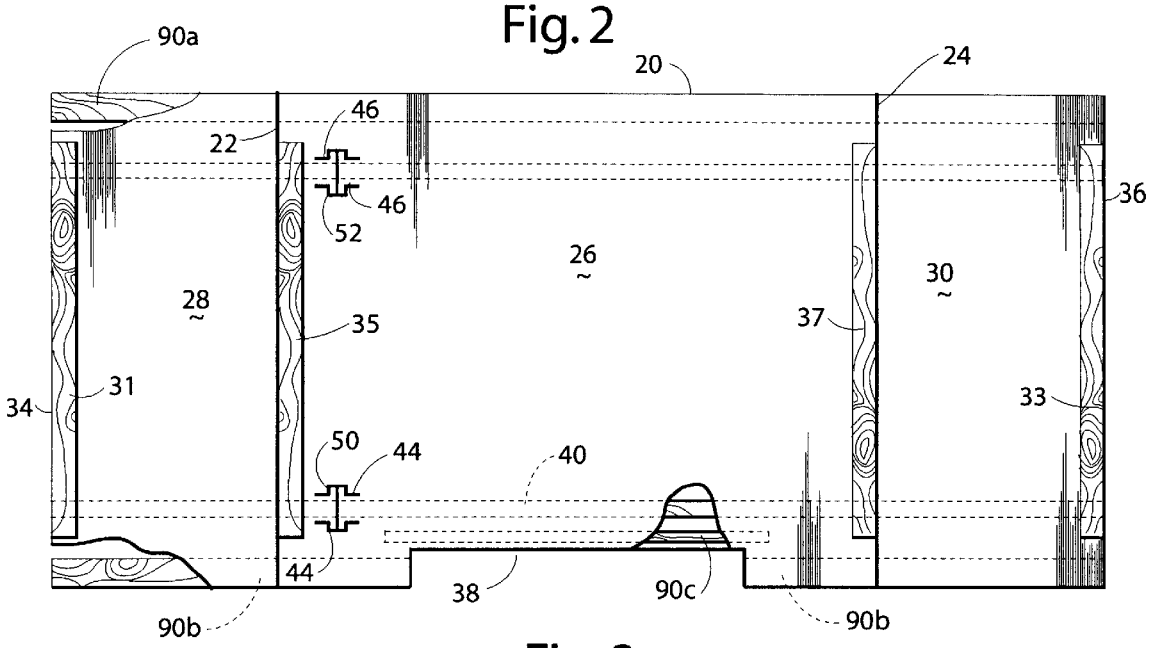
FIG. 2 illustrates a top plan view of a wing-end panel used with the container shown in FIG. 1.

Referring now in more detail to the drawings in which like parts have like identifiers, FIG. 1 illustrates an exploded perspective view of a wing-end container 10 according to the present invention. The container 10 assembles from a pair of opposing wing-end panels 12 that connect to a top frame 14 and a base frame 16. With reference to FIGS. 1 and 2, the wing-end panels 12 each comprise an elongate sheet of corrugated paperboard sheet 20 having a pair of spaced-apart scores 22, 24. The scores 22, 24 define an end panel 26 separating two side wing panels 28, 30. At least four spaced-apart cleats 31, 33, 35, and 37 attach to an interior surface of the elongate sheet 20. The cleats 31, 33, 35, and 37 are elongate stiff members with sufficient compression strength parallel to the longitudinal axis to serve as reinforcing members when stacking containers 10. The cleats 31, 33, 35 and 37 are made of strong materials, such as wood, FIBRE/CORE brand structural members available from North American Container Corporation, Atlanta, Ga., or other suitable material. The cleats 31, 33 attach at a respective side edge 34, 36 and the cleats 35, 37 attach to the end panel 26 next to the scores 22, 24. The end panel 26 defines a notched recess 38 in a lower portion of the panel, for a purpose discussed below.

In the illustrated embodiment, the sheet 20 includes two spaced-apart elongate tear tapes 40, 42. The tear tapes 40, 42 extend the length of the sheet 20 substantially parallel to a longitudinal axis. The tear tapes 40, 42 are conventionally made into the corrugated sheet, generally positioned next to the innermost liner during the corrugating operation. Two pairs of opposing flaps 44, 46 are defined in the end panel 26 by a plurality of slits 50, 52. The slits 50, 52 generally define an H-shape. The tapes 40, 42, attach to the flaps 44, 46 for a purpose discussed below. The tapes 40, 42 terminate at respective distal ends 54, 56 at the slit 58, 59 separating the respective flaps 44, 46.

Attaching strips 90*a*, 90*b*, and 90*c* are positioned along opposing edges of the panels 26, 28, and 30. The attaching strips 90 are preferably made of a dense material, and each extends substantially the length of their respective panel 26, 28, and 30. In an alternate embodiment, several lengths of an elongate dense material are positioned spaced-apart and in linear alignment on the panel as the attaching strip. The attaching strips may be formed of fibreboard, wood, paperboard, or a like material suitable for rigidly holding staples or other fasteners. The attaching strips 90 are preferably bonded to the panels 26, 28, and 30 with adhesive during manufacture. In an alternate embodiment, only the attaching strips 90*a* and 90*b* are used. In an embodiment using attaching strips 90 that do not bend (i.e., wood), separate pieces are used so that the attaching strips do not extend over the scores 22, 24. In a preferred embodiment, the attaching strip 90*a* extends the full length of the corrugated paperboard sheet along a top edge. Attaching strips 90*b* extend the length of the wing panels 28, 30, over the scores 22, 24, and substantially to the edge of the cutout 38. In this configuration, the attaching strips 90 serve the dual purpose of defining a denser material (than the corrugated paperboard sheet 20) to hold staples and to prevent the staples from pulling through. The attaching strips also reinforce the corners defined by the scores 22, 24 by increasing the tensile strength. The corners defined by the scores 22, 24 take most of the diagonal racking forces.

With continuing reference to FIG. 1, the top frame 14 comprises four longitudinally extending top members 60. The top members 60 attach at distal ends to two end members 62 transverse to the top members. The top members 60 also attach to two transverse intermediate members 64. The end members 62 and the intermediate members 64 each define a notch 66 at opposing distal ends. In an alternate embodiment, the members 62 and 64 comprise a first member with a second member of a shorter length rigidly connected to a bottom surface to define notches at opposing distal ends. This eliminates the notching process but adds material costs. Headers 68 connect to the outside top members 60*a*, 60*b* between the respective intermediate member 64 and the end member 62. The notches 66 cooperate with the distal ends of the headers 68 to define pockets for receiving the respective upper ends of the cleats 31, 33, 35, and 37, as discussed below. The width of the notch 66 in the respective end members 62 are substantially equal to the width of the cleats 35, 37 plus a tolerance to allow for ease of insertion. The width of the notch 66 on the intermediate members 64 substantially equal to the width of the cleats 31, 33 plus a tolerance. Generally all of the cleats 31, 33, 35, and 37 have the same thickness. In one embodiment, the corner cleats 35, 37 are wider than the wing cleats 31, 33, as the corner cleats are more subject to external blows in pressure from handling machinery such as forklift trucks and clamp trucks.

The base frame 16 is adapted to support a heavy durable article, such as a all-terrain vehicle, a riding tractor, or other such heavy article. The base frame 16 in the illustrated embodiment comprises two outside runners 70 and two intermediate runners 72. In an alternate embodiment, there is only one intermediate runner, depending on product weight and length of the base, which affect the bending characteristics of the base when the container 10 is handled by a forklift inserted from an end. Transverse members 73 connect to the runners 70, 72, to form a rigid pallet. Each end of the base frame 16 includes two end members 74 which extend between an outside runner 70 and an intermediate runner 72. The distal ends of the members 74 define a gap 76 therebetween, for a purpose discussed below. An upper transverse member 78 connects on upper surfaces of the members 70, 72, and 74. The opposing distal ends 80, 82 of the members 78 define partial mortises 81, 83 for receiving a lower portion of the wood cleats 35, 37 on the end panel 26, as discussed below. The illustrated base frame 16 is particularly adapted for receiving a riding tractor. The base frame 16 includes two opposing members 84 that define chocks for bearing on wheels of the garden tractor packed on the pallet 16. A pair of opposing members 86 are disposed offset from side edges defined by the runners 70. The members 86 restrain the garden tractor from moving during handling and shipment as well as facilitating proper positioning of the garden tractor on the base. It is to be appreciated that a variety of pallets can be assembled to suit the particular product being packaged in the container of the present invention.

Figure 3:
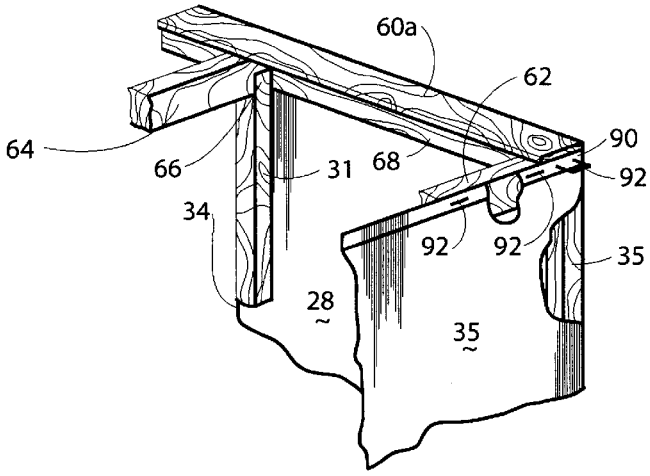
FIG. 3 illustrates a detailed view of a transverse member of a top frame resting on an upper end of a cleat in the container shown in FIG. 1.

FIG. 3 illustrates a detailed view of the transverse member 64 of the top frame 14 resting on the upper end of the cleat 31 of the side wing 28. In an alternate embodiment (not illustrated), the end member 62 likewise includes the notched end 66 for resting on the cleats 35, 37. FIG. 3 further illustrates the attaching strip 90 disposed on an outside surface of the side panels 28, 30 and the end panels 26. The plurality of staples 92 are driven through the attaching strip 90, the respective panel 26, 28 and 30, and into the aligned wood member 62, 68 of the top frame 14. The attaching strip 90 is used on both the upper and the lower portion of the wing end panels 12 as best illustrated in FIG. 2.

The wing-end container 10 of the present invention is particularly useful for assembly on production lines for heavy durable equipment, such as large garden tractors, riding lawn mowers, all-terrain vehicles, and other heavy equipment. With reference to FIG. 1, the base frame 16 is obtained from a stack in the packaging section of the production line. The tractor to be enclosed in the container 10 is positioned on the base frame 16. The opposing wing-end panels 12 and the top frame 14 are then attached.

In one method, the opposing wing-end panels 12 are first attached to the top frame 14. The assembly of the wing-end panels 12 and the top frame 14 is then hoisted over the tractor on the base frame 16 and lowered into engagement with the base frame. This method is accomplished by positioning the top frame 14 on a support which permits access to the outside frame members 60*a*, 60*b* and the end members 62. One of the wing-end panels 12 is substantially aligned with the end member 62 of the top frame 14. The side wings 28, 30 are folded on the scores 22, 24. As best illustrated in FIG. 3, the notches 66 of the intermediate member 64 sit on an upper end of the opposing cleats 31, 33. An inside face of the notch 66 bears against an outside face of the respective cleat 31, 33. The headers 68 on the opposing sides of the top frame 14 are wedgingly received in respective gaps between the cleats 31, 35 and 33, 37. The wedging engagement of the headers 68 to the cleats 31, 35 and 33, 37 holds the side wings 28, 30 in a squared position at the end of the top frame 14. The cleats 35, 37 are received in the mortises 81, 83. While being held in this position, the end panel 26 is stapled to the end member 62 of the top frame 14. The side wing panels 28, 30 are likewise stapled to the headers 68 on the opposing sides of the top frame 14. The attaching strip 90*a* on outside surfaces of the end panel 26 and the side wing panels 28, 30 receive the staples 92 through the attaching strip, the panels and into the members 62 and 68 of the top frame 14. Staples driven through the attaching strip 90*b* seat in the runners 70. Staples driven through the attaching strip 90*c* seat in the side of the end members 78.

The second wing-end panel 12 is likewise secured to the top frame 12 as discussed above. Upon completion of the joining of the opposing wing-end panels 12 to the top frame 14, the assembly is lifted over the base frame 16 and lowered, thereby enclosing the article held on the base frame 16. The lower portions of the respective side wing panels 28, 30 and the end panels 26 are secured with staples to the base frame 16.

Figure 4:
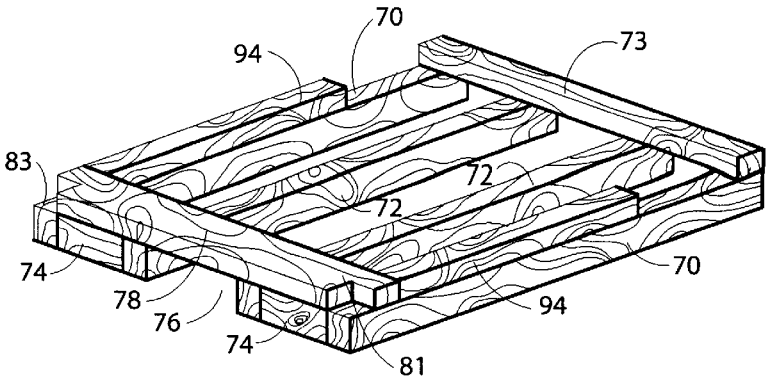
FIG. 4 illustrates a portion of an alternate embodiment of a base frame for the container shown in FIG. 1.

FIG. 4 illustrates a portion of an alternate embodiment of the base frame 16. The second method uses this embodiment. The outside runners 70 each include headers 94. The gaps between the respective cleats 31, 35 and 33, 37 wedgingly receive the headers 94 in a lower portion of the respective wing panels 28, 30. This holds the wing-end panel 12 in position around an end of the base frame 16. The lower portions of the respective panels 26, 28, and 30 are thereafter secured with staples driven through the attaching strips 90 and the panels into the base frame 16. The top frame 14 is then placed on the upper ends of the wing-end panels 12. As illustrated in FIG. 3, the notches 66 of the intermediate members 64 sit on the upper ends of the opposing cleats 35, 37. The inside face of the notch 66 bears against the outside face of the respective cleat. The upper portions of the respective side wing panels 28, 30 and the end wing panels 26 are secured with staples to the top frame 14.

With reference to FIG. 1, it is to be appreciated that the container of the present invention provides an access window 92 on the opposing sides of the container 10. The respective window 92 extends between the opposing edges 34, 36 of the two wing-end panels 12 at opposing ends of the container 10. As illustrated in FIG. 1, each wing panel 28, 30 defines a portion of the side of the container 10, with the gap between the edges of panels 28, 30 on a side of the container defining the window 92. The window 92 eliminates the need to disassemble a package to perform checks and repairs of the apparatus enclosed in the container 10. Preferably, the window 92 is defined to provide access to a relevant portion of the goods held on the base frame 16. For example, the window 92 in the illustrated embodiment provides access to a mid-portion of a tractor held on the base frame 16, which mid-portion contains the engine and operating controls. In this way, containers 10 do not have to be opened and re-closed in order to replace parts or make minor repairs, which may be required during manufacturing activities. It is to be appreciated that the access window 92 on one side may be defined in a portion of the container having the engine, while the window 92 on the opposing side is defined at a rear portion of the tractor, for example, to provide access to a transmission at the rear of the tractor. This is accomplished by having the side wings 28, 30 of different widths. In this embodiment, an additional cleat may be required on the longer of the side wing panels to align with the opposing cleat on the shorter panel. It is noted that the goods within the container 10 may be wrapped in plastic jackets to seal from dust and dirt.

It is preferred that the panels 28, 30 have a length that is approximately one-third the length of the pallet 16. This results in the access window 92 being approximately one-third the base length. As discussed above, alternate embodiments in the practice of the present invention varies the respective lengths of the panels 28, 30 and the access window 92 due to the need to position the cleats 31, 33 to clear features of the product contained within the container 10, such as cutter housings on a lawn tractor, which may be the outer most protrusion. It is preferable, however, subject to the constraints of the particular product to be packaged, that both wings 28, 30 be identical in length so that the same wing end panel 12 can be used on either end of the container.

Further, the container 10 permits greater access to the article in the container 10 if necessary. The side wings 28, 30 can each be individually unstapled from the top frame 14 and the base frame 16, and swung away on the scores 22, 24 to provide wider access to a particular portion of the article in the container 10. Full access to both sides of the container 10 can be obtained by releasing the staples on all four side wings 28, 30 without further disassembly of the container 10. The top frame 16 loads the cleats 35, 37 on the opposing end panels 26. The stacked containers 10 thereby do not need to be unstacked when making inspection and repairs to tractors held within the containers 10.

The present invention further provides the tear tapes 40, 42 to tear open the container 10 without the use of utility knives, thereby avoiding damage to the goods. The flaps 44, 46 are opened, and grasping the respective flap 44, 46, the tear tape 40, 42 is pulled. Pulling the tear tapes 40, 42 rips out the liners and mediums outward of the tear tape, which liners and mediums comprise the corrugated paperboard sheet 12. The tear tapes 40, 42, adhered to the inner liner, also tear out the inner liner. Thus, the entire thickness of the corrugated paperboard sheet 12 is separated along the length of the sheet as the tear tapes are pulled out. The tear tape 40 separates a lower portion of the container panels from an intermediate portion and the upper tear tape 42 separates an upper portion from the intermediate portion.

Further, the flaps 44 provide access into the container 10. For example, occasionally, the loaded container 10 must be pulled from a trailer prior to opening the container. This is accomplished by opening the flap 44 and attaching a chain to the tractor within the container 10. The chain is then used to pull the entire container 10 from the trailer.

The container 10 of the present invention uses less corrugated paperboard than conventional double wall tube container designs. This allows the container 10 to occupy less volume in shipping. Although such containers are shipped "knocked-down", the overall length of the knocked-down tube equals the length of one side and one end panel. The present invention, however, ships from the container manufacturer in a shorter overall length. In a preferred embodiment, the wing-end panel 12 is shipped with one panel 28 reverse folded underneath the panel 26 and stacked on another one of the wing-end panels 12 with a reverse folded wing panel 28. The alternating sets of wing-end panels 12 and top frames 16 can be stacked in the sequence of use. This facilitates using the container 10 by the packaging department to keep up with the production line.

After the top frame 14 and the base frame 16 are stapled to the wing-end panels 12, the container 10 carrying the tractor, or other article is then handled for storage and shipping. The container 10 is readily stacked one on another. The top frame 14 communicates compression loading from other containers in the stack through the cleats 31, 33, 35, and 37 to the base frame 16. During travel or with use of a clamp truck to handle the container 10, the notches 66 bear against the respective opposing cleats 35, 37 of the side wing panels 28, 30. This resists the inward force of the parallel platens of the clamp truck against the side portion of the container 10 and prevents the sides separating from the top frame 14. The partial mortises 81, 83 in the wood members 78 do not go all the way through the thickness, but leave a portion at the bottom. This can vary depending upon the thickness of the end member 78, based upon the weight of the product to be held in the container 10, the length of the member 78, and the number of containers typically handled with forklifts at a single time. The lower ends of the cleats 35, 37 sit down into the mortise 81, 83 as illustrated in FIG. 1. Generally, the mortises 81, 83 are sized for seating of the cleats 35, 37 with a tolerance for variations on positioning of the cleats to facilitate assembly. The bottom of the mortise is furthermore reinforced against breaking out during stacked handling of the product by the stringers 70 to which the members 78 are secured, preferably with nails. The back and end of the cut-away portion of the mortise define "stops" which reinforce the cleats 35, 37 when subjected to external forces such as clamp truck platens or bumping and pushing of the pack with blades of a fork truck. In the event that a conventional fork lift truck is used to pick up the container 10, the forks of the fork lift truck are received through the notch 38 of the end panel 26, whereby the forks bear against bottom surfaces of members in the base frame 16. One of ordinary skill appreciates that the runners 70 in an alternate embodiment define openings for side entry of forks.

It is thus seen that the present invention provides a readily assembled container for enclosing goods on the base frame with stacking and diagonal racking strength using wood cleated wing-end panels that define end and side portions to the container, with access windows on opposing sides for inspection and repair of goods enclosed within the container. While this invention has been described in detail with particular reference to the preferred embodiments thereof, the principles and modes of operation of the present invention have been described in the foregoing specification. The invention is not to be construed as limited to the particular forms disclosed because these are regarded as illustrative rather than restrictive. Moreover, modifications, variations and changes may be made by those skilled in the art without departure from the spirit and scope of the invention as described by the following claims.

What is claimed is:

1. A packing container for enclosing heavy durable goods for storage and shipping, comprising:

a base frame for supporting an article to be packaged for storage and shipping;

a pair of opposing wing-end panels received at opposing ends of the base frame, each wing-end panel comprising:

an elongate sheet of corrugated paperboard scored to define an end panel separating two side wing panels; and at least four spaced-apart cleats attached to an interior surface of the elongate sheet, one cleat at each side edge and one at each of the scores, whereby the end panel is received at one end of the base frame with the two side wing panels folding on the respective scores to cover portions of the opposing sides of the container, the respective opposing side wing panels on each side of the container leaving a gap between the opposing edges of the two side wing panels; and a top frame received by the pair of opposing wing-end panels.

2. The packing container as recited in claim 1, wherein the wing-end panels are attached to the base frame with staples.

3. The packing container as recited in claim 1, further comprising an attaching strip extending substantially the length of a side of the container and aligned with the base frame for receiving staples therethrough into the base frame for securing the wing-end panel thereto.

4. The packing container as recited in claim 3, further comprising a second attaching strip extending substantially the length of corrugated paperboard sheet and aligned with the top frame for receiving staples therethrough into the top frame for securing the wing-end panel thereto.

5. The packing container as recited in claim 1, wherein the plurality of cleats attach to the panel in spaced-apart relation adjacent the scores and end portions of the panel.

6. The packing container as recited in claim 1, wherein the corrugated paperboard sheet defines a flap in the end panel; and further comprising a tear tape extending parallel to a longitudinal axis of the corrugated paperboard sheet and adhered thereto which tape crosses over the flap, whereby the flap, being extended outwardly from the corrugated paperboard sheet and pulled, causes the tear tape to pull through the corrugated paperboard panel, separating a first portion thereof from a second portion for opening the pack to remove the goods therein.

7. The packing container as recited in claim 6, wherein the flap is in a lower portion of the corrugated paperboard sheet.

8. The packing container as recited in claim 7, further comprising a second flap in an upper portion of the corrugated paperboard sheet; and further comprising a second tear tape extending parallel to the longitudinal axis of the corrugated paperboard sheet and adhered thereto which tape crosses over the second flap, whereby the second flap, being extended outwardly from the corrugated paperboard sheet and pulled, causes the second tear tape to pull through the corrugated paperboard panel, separating a third portion thereof from the second portion for opening the pack to remove the goods therein.

9. The packing container as recited in claim 1, wherein a gap defined between two of the plurality of cleats that attach to the corrugated paperboard sheet at a side edge and at the score near thereto wedgingly receives an elongate member of the top frame, whereby the wing-end panels self-align with the top frame while being held in a squared position by the gap wedgingly receiving the elongate member therein.

10. The packing container as recited in claim 1, wherein the top frame comprises a transverse member extending between opposing sides in alignment with two opposing cleats attached to the corrugated paperboard panel.

11. The packing container as recited in claim 10, wherein the opposing distal ends of the transverse member defines notched recesses in a lower surface, whereby the notch of the transverse member rests on an upper end of the aligned cleat with a portion of the notch bearing against an inner surface of the cleat.

12. The packing container as recited in claim 1, wherein the top frame comprises:

a plurality of thin, spaced-apart first members extending longitudinally across the container and defining an upper surface of the top frame;

four spaced-apart transverse members, each for aligning with two of the cleats on opposing sides of the container; and a pair of elongate second members attached to a lower surface of each of the outwardly disposed first members and of a length to be wedgingly received in a gap defined between two of the cleats on a side of the container.

13. The packing container as recited in claim 12, wherein opposing distal ends of each transverse member defines notched recesses in a lower surface, whereby the notched recess of the transverse member rests on an upper end of the cleat aligned therewith with a side portion of the notched recess bearing against an inner surface of the cleat.

14. The packing container as recited in claim 1, wherein a lower portion of at least one of the end panels defines a notch for receiving forks of a forklift truck into a portion of the base frame for lifting and handling the container.

15. A packing container for enclosing heavy durable goods for storage and shipping, comprising:

a base frame for supporting an article to be packaged for storage and shipping;

a pair of opposing wing-end panels received at opposing ends of the base frame, each wing-end panel comprising:

an elongate sheet of corrugated paperboard scored to define an end panel separating two side wing panels; and four spaced-apart cleats attached to an interior surface of the elongate sheet, one cleat at each side edge and at the scores, whereby the end panel is received at one end of the base frame with the two side wing panels folding on the respective scores to cover portions of the opposing sides of the container, the respective opposing side wing panels on each side of the container leaving a gap between the opposing edges of the two side wing panels; and a top frame received by the pair of opposing wing-end panels, the top frame comprising:

a plurality of thin, spaced-apart first members extending longitudinally across the container and defining an upper surface of the top frame;

four spaced-apart transverse members, each for aligning with two of the cleats on opposing sides of the container; and a pair of elongate second members attached to a lower surface of each of the outwardly disposed first members and of a length to be wedgingly received in a gap defined between two of the cleats on a side of the container.

16. The packing container as recited in claim 15, wherein the wing-end panels are attached to the base frame with staples.

17. The packing container as recited in claim 15, further comprising an attaching strip extending substantially the length of a side of the container and aligned with the base frame for receiving staples therethrough into the base frame for securing the wing-end panel thereto.

18. The packing container as recited in claim 17, further comprising a second attaching strip extending substantially the length of corrugated paperboard sheet and aligned with the top frame for receiving staples therethrough into the top frame for securing the wing-end panel thereto.

19. The packing container as recited in claim 15, wherein the plurality of cleats attach to the panel in spaced-apart relation adjacent the scores and end portions of the panel.

20. The packing container as recited in claim 15, wherein the corrugated paperboard sheet defines an flap in the end panel; and further comprising a tear tape extending parallel to a longitudinal axis of the corrugated paperboard sheet and adhered thereto which tape crosses over the flap, whereby the flap, being extended outwardly from the corrugated paperboard sheet and pulled, causes the tear tape to pull through the corrugated paperboard panel, separating a first portion thereof from a second portion for opening the pack to remove the goods therein.

21. The packing container as recited in claim 20, wherein the flap is in a lower portion of the corrugated paperboard sheet.

22. The packing container as recited in claim 21, further comprising a second flap in an upper portion of the corrugated paperboard sheet; and further comprising a second tear tape extending parallel to the longitudinal axis of the corrugated paperboard sheet and adhered thereto which tape crosses over the second flap, whereby the second flap, being extended outwardly from the corrugated paperboard sheet and pulled, causes the second tear tape to pull through the corrugated paperboard panel, separating a third portion thereof from the second portion for opening the pack to remove the goods therein.

23. The packing container as recited in claim 15, wherein the opposing distal ends of each of the transverse members defines notched recesses in a lower surface, whereby the notch of the transverse member rests on an upper end of the aligned cleat with a portion of the notch bearing against an inner surface of the cleat.

24. The packing container as recited in claim 15, wherein a lower portion of at least one of the end panels defines a notch for receiving forks of a forklift truck into a portion of the base frame for lifting and handling the container.

25. A method of enclosing heavy durable goods in a packing container for storage and shipping, comprising the steps of:

(a) positioning an article to be packaged for storage and shipping on a base frame;

(b) attaching a pair of opposing wing-end panels to opposing ends of a top frame, each wing-end panel formed of a corrugated paperboard sheet having two scores therein to define an end panel separating two side wing panels, the side wing panels folding on the scores to define portions of opposing sides of the container;

(c) holding the side wing panels to a top frame until fixed thereto by wedgingly engaging an elongate member of the top frame in a gap defined between two cleats attached to a side edge and the one of the scores nearer thereto, whereby the wing-end panels self-align with the top frame while being held in a squared position, the respective opposing side wing panels on each side of the container leaving a gap between the opposing edges of the two side wing panels; and (d) placing the top frame with the opposing wing-end panels over the base frame to enclose the article therein for storage and shipping.

* * * * *